United States Patent [19]

Gooding

[11] Patent Number: 4,885,892

[45] Date of Patent: Dec. 12, 1989

[54] COMPOSITE BEAMS

[76] Inventor: P. G. Gooding, 7 Kirrawee Road, North Gosford NSW 2250, Australia

[21] Appl. No.: 207,716

[22] Filed: Jun. 16, 1988

[30] Foreign Application Priority Data

Jun. 16, 1987 [AU] Australia ..... PI2520

[51] Int. Cl.[4] ..... E04C 3/07

[52] U.S. Cl. ..... 52/690; 52/696

[58] Field of Search ..... 52/690, 696, 729, 799, 52/800

[56] References Cited

U.S. PATENT DOCUMENTS

| | | | |
|---|---|---|---|
| 1,649,577 | 11/1927 | Coryell | 52/696 X |
| 3,938,289 | 2/1976 | Falkenberg | 52/800 |
| 4,523,419 | 6/1985 | Palacio et al. | 52/696 X |

FOREIGN PATENT DOCUMENTS

| | | | |
|---|---|---|---|
| 1073305 | 6/1967 | United Kingdom | 52/696 |

*Primary Examiner*—David A. Scherbel
*Assistant Examiner*—Anthony W. Williams
*Attorney, Agent, or Firm*—Bryan, Cave, McPheeters & McRoberts

[57] ABSTRACT

A beam of the type used in the building industry comprising a top and bottom plate (1, 2) secured in a fixed spaced relationship from each other by corrugated sheet metal (3); the metal (3) being dispersed such that its planar surfaces span the distance between the top and bottom plates (1, 2) with the corrugations configured substantially as a rectangular wave having surfaces (4) parallel to the longitudinal axis of the plates and additionally surfaces (8) substantially transverse to such axis; the arrangement being such that the substantially transverse surfaces (8) act as spacers between the top and bottom plates (1, 2) whereas the surfaces (4) of the corrugated metal (3) lying parallel to the longitudinal axis of the top and bottom plates (1, 2) extend part way up the sides of the top and bottom plates (1, 2) to facilitate fixing thereto.

3 Claims, 2 Drawing Sheets

11
12
13
3
4
8
9
10
14

COMPOSITE BEAMS

BACKGROUND OF THE INVENTION

The present invention relates to the building trade and in particular to a particular type of bracing for beams used as lintels, purlins, bearers and other such applications.

Traditionally beams such as lintels or bearers have been cut from a single piece of timber or formed from relatively heavy steel into I, J or C sections.

Alternatively where framing is required over a window or the like in a dwelling a top and bottom plate are formed from timber with small upright studs. All of the last-mentioned methods of forming a beam have disadvantages. For example solid timber is now quite expensive and is still subject to twisting and warping in addition to being quite heavy such as to preclude large beams being handled readily by one or two men.

Metal beams are even heavier to the extent that they can often not be "hand set" and require the use of expensive machinery. The fabrication of a frame is additionally not entirely satisfactory since it is difficult to brace according to traditional methods and is time consuming to fabricate on site.

SUMMARY OF THE INVENTION

It is accordingly the object of the present invention to ameliorate one or more of the above-mentioned disadvantages with the prior art or at least to provide the consumer with a choice.

According to the present invention there is provided a beam of the type used in the building industry comprising a top and bottom plate secured in a fixed spaced relationship from each other by corrugated sheet metal; the metal being dispersed such that its planar surfaces span the distance between the loop and bottom plates with the corrugations configured substantially as a rectangular wave having surfaces parallel to the longitudinal axis of the plates and additionally surfaces substantially transverse to such axis; the arrangement being such that the substantially transverse surfaces act as spacers between the top and bottom plates whereas the surfaces of the corrugated metal lying parallel to the longitudinal axis of the top and bottom plates extend part way up the sides of the top and bottom plates to facilitate fixing thereto.

BRIEF DESCRIPTION OF THE DRAWINGS

One embodiment of the present invention will be described with reference to the accompanying drawings in which.

DETAILED DESCRIPTION OF A PREFERRED EMBODIMENT

Figure 3:
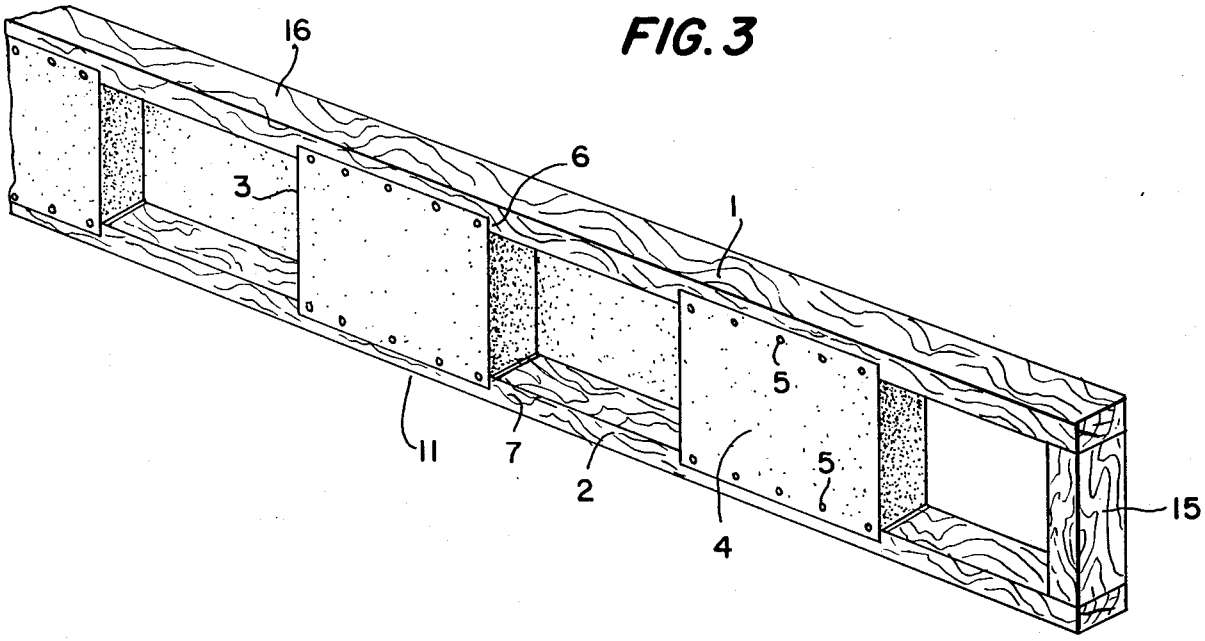
FIG. 3 is a perspective view of a length of beam in accordance with the present invention.

The embodiment of FIG. 3 depicts top and bottom plates 1 and 2 respectively formed from timber as well as corrugated galvanized sheet metal bracing 3 between the top and bottom plates. It will be observed that the sheet metal bracing 3 (in this instance 20 gauge) is fixed to the top and bottom plates along the top and bottom extremities of the longitudinal surfaces 4 by means of nailing through the holes 5 to the sides 6 and 7 of the top and bottom plates 1 and 2 respectively.

Figures 1, 2:
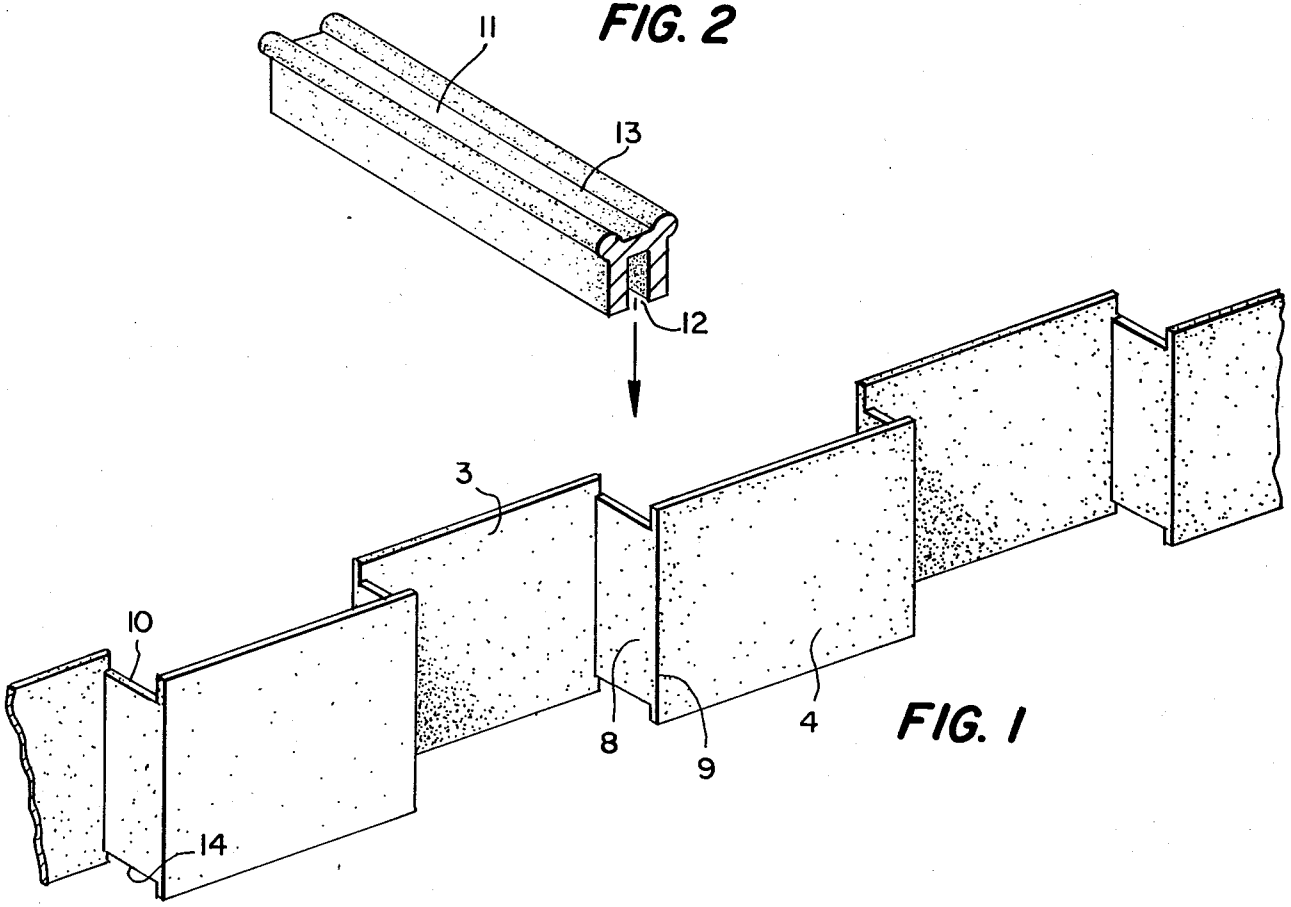
FIG. 1 is a perspective view of corrugated sheet metal bracing for use in the present invention.
FIG. 2 is a perspective view of a load spreading extrusion for use in conjunction with the present invention.

The nature of the corrugated sheet metal 3 may best be observed from FIG. 1 which clearly depicts the longitudinal surfaces 4 and the transverse surfaces 8. It will be noted that there is a distinct fold line 9 separating the longitudinal surfaces 4 from the transverse surfaces 8 and it is this fold at approximately ninety degrees which serves to impart strength to the beam.

The top plate of the finished beam is designed to rest on the top edges 10 of transverse surfaces 8. These edges 10 lie below the top of adjacent top edges of longitudinal surfaces 4 in order to cradle the top plate.

In order that edges 10 may not cut into the top plate extrusion 11 (shown in enlarged form in FIG. 2) is utilized between edge 10 and the top plate. Channel 12 in extrusion 11 slips over the relatively narrow and sharp edges 10 before the top plate is laid in space. The top plate may then be laid over the top surface 13 of extrusion 11.

Identical extrusions 11 may be utilized between the lower edges 14 of transverse surfaces 8 before the bottom plate is affixed.

It will be noted from FIG. 3 that the ends of the beams may be blocked for strength utilizing a timber block 15 and similarly it will be observed that the configuration of the finished beam is such that its strength may be augmented by blocking at any area in between transverse surfaces 14. Thus if a point load is anticipated at 16 then a block may be introduced and fixed below such point.

It is not essential that the top and bottom plates be fabricated from timber as the present invention may utilize steel top and bottom plates or indeed top and bottom plates of other materials. It is however envisaged that timber top and bottom plates may be of greatest utility having regard to the fact that they provide ready fixing for adjacent building elements.

It should be appreciated that the present invention is not restricted to the above-described embodiment and that alternate embodiment may be devised without departing from the scope and intendment of the present invention.

I claim:

1. A composite beam, comprising:

top and bottom plates, in mutual spaced, substantially parallel relationship;

a corrugated sheet extending between and affixed to said top and bottom plates, having corrugations including a plurality of longitudinal surfaces, generally oriented parallel to the longitudinal axis of said top and bottom plates;

a plurality of transverse surfaces, generally oriented perpendicular to said longitudinal axis;

wherein edges of said transverse surfaces bear against adjacent surfaces of each of said plates and said longitudinal surfaces overlap and are affixed to said plates; and a plurality of load spreading members, interposed betweens said transverse surface edges and said plates, each said member having a channel for receiving a said edge and a load bearing face with an area greater than the area of said edge, said load bearing face being positioned in contact with a said plate.

2. The composite beam of claim 1, wherein said top and bottom plates are formed from timber having a rectangular cross-section.

3. The composite beam of claim 1, wherein said longitudinal surfaces overlie a portion of each said plate and are affixed thereto; and said top and bottom plates are formed from timber having a rectangular cross-section.

* * * * *